US011566485B1

(12) United States Patent
Oliphant et al.

(10) Patent No.: US 11,566,485 B1
(45) Date of Patent: Jan. 31, 2023

(54) ASSEMBLY METHOD FOR COMMUNICATING WITH LINE IN WELLHEAD

(71) Applicant: WEATHERFORD TECHNOLOGY HOLDINGS, LLC, Houston, TX (US)

(72) Inventors: Martin Robert Douglas Oliphant, Aberdeen (GB); Keith Adams, Inverurie (GB); Robert Andrew Hunt, Great Yarmouth (GB)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 17/488,815

(22) Filed: Sep. 29, 2021

(51) Int. Cl.

| | |
|---|---|
| ***E21B 33/038*** | (2006.01) |
| ***E21B 33/068*** | (2006.01) |
| ***E21B 33/04*** | (2006.01) |
| ***E21B 34/02*** | (2006.01) |

(52) U.S. Cl.
CPC ..... *E21B 33/068* (2013.01); *E21B 33/04* (2013.01); *E21B 34/02* (2013.01)

(58) Field of Classification Search
CPC .... E21B 33/068; E21B 33/0387; E21B 34/02; E21B 34/04
See application file for complete search history.

(56) References Cited

U.S. PATENT DOCUMENTS 7,013,970 B2 3/2006 Collie et al.
7,325,597 B2 2/2008 Ringgenberg et al.
7,712,537 B2 5/2010 Hill et al.
7,823,648 B2 11/2010 Bolding et al.
8,297,359 B2 10/2012 McKay et al.
8,646,536 B2 * 2/2014 Travis ..... E21B 34/102 166/382
9,187,980 B2 11/2015 McHugh et al.
(Continued)

FOREIGN PATENT DOCUMENTS

EP 2351906 A2 8/2011
GB 2504104 A 7/2012
(Continued)

OTHER PUBLICATIONS

Weatherford. "Capillary Injection System." Publication, 2006 Weatherford. 15 pages.
(Continued)

*Primary Examiner* — Cathleen R Hutchins
*Assistant Examiner* — Ronald R Runyan
(74) *Attorney, Agent, or Firm* — Cabello Hall Zinda, PLLC

(57) ABSTRACT

An assembly is used for chemical injection through a wellhead to a capillary line in a well. A capillary hanger installs in the wellhead to support the capillary line. A no-return valve of the capillary hanger prevents fluid communication uphole from the supported capillary line. An injection module mounts above a gate valve on the wellhead and includes a movable mandrel disposed therein. Hydraulic pressure applied to a piston chamber in the module extends the mandrel through the open gate valve so that a distal end of the mandrel can open the no-return valve. At this point, chemical injection introduced into the module can communicate through a flow bore of the extended mandrel, through the open non-return valve, and on through the supported capillary line in the well.

20 Claims, 12 Drawing Sheets

(56) References Cited

U.S. PATENT DOCUMENTS

| | | | | |
|---|---|---|---|---|
| 9,284,808 | B2 | 3/2016 | Wright | |
| 10,738,557 | B2 | 8/2020 | Donald et al. | |
| 11,008,854 | B2 | 5/2021 | Oliphant et al. | |
| 2004/0079532 | A1 | 4/2004 | Allen et al. | |
| 2009/0294134 | A1* | 12/2009 | Jones | E21B 34/105 166/381 |
| 2015/0068769 | A1 | 3/2015 | Xiao et al. | |
| 2015/0354308 | A1 | 12/2015 | June et al. | |
| 2016/0060991 | A1 | 3/2016 | Nguyen | |
| 2021/0062610 | A1* | 3/2021 | Garay | E21B 34/10 |

FOREIGN PATENT DOCUMENTS

| | | | |
|---|---|---|---|
| WO | 2006041811 | A2 | 4/2006 |
| WO | 2006069247 | A2 | 6/2006 |
| WO | 2009014797 | A1 | 1/2009 |

OTHER PUBLICATIONS

Weatherford. "Capillary-Injection Technology." Publication 2013 Weatherford. pp. 1-8.

Weatherford. "Chemical-Injection Side-Pocket Mandrels-Round, Solid-Body SBRO-CI Series." Publication, 2005-2007 Weatherford. 4 pages.

Weatherford. "Renaissance(TM) Systems Revive wells at a fraction of the cost of workovers with Weatherford's unique safety-valve innovations." Publication, 2009-2011 Weatherford. pp. 1-23.

Weatherford. "WCS Opti-Chem(TM) Chemical-Injection Safety Valve System." Publication, 2011 Weatherford. weatherford.com. pp. 1-5.

Int'l Search Report and Written Opinion in counterpart PCT Appl. PCT/US2022/042263 dated Nov. 22, 2022.

* cited by examiner

ASSEMBLY METHOD FOR COMMUNICATING WITH LINE IN WELLHEAD

BACKGROUND OF THE DISCLOSURE

At times, well operations require capillary lines to be run downhole from an existing wellhead into a live well. In some situations, a capillary line needs to be run downhole extending from the wellhead so chemical injection can be performed downhole. In other situations, a hydraulically-actuated tool needs to be run downhole and needs to be controlled by a new control line extending from the wellhead. For example, an existing safety valve installed downhole may stop functioning because an existing control line to the safety valve has become blocked or damaged. When the hydraulic pressure is lost, the existing safety valve closes so that production from the well stops. Operators then need to run and install a surface-controlled subsurface safety valve and an alternate control line through the wellhead and into the production tubing so production can be restored.

These and other situations require operators to extend a capillary line from the wellhead and to communicate control fluids, chemicals, or the like into the capillary line. Doing this for a live well in an effective way can be challenging. To that end, the subject matter of the present disclosure is directed to overcoming, or at least reducing the effects of, one or more of the problems set forth above.

SUMMARY OF THE DISCLOSURE

An assembly disclosed herein is for communicating a media through a wellhead to a media line in a well. The wellhead has at least one gate valve mounted above the wellhead. The assembly comprises a module, a housing, and a mandrel. The module configured to install in the wellhead and is configured to support the media line extending therefrom. The housing is configured to mount above the at least one gate valve and has an insertion port for the media. The mandrel is disposed in the housing and has a proximal end and a distal end. The mandrel defines a bore therethrough from the proximal end to the distal end for the media. The mandrel is movable between a retracted condition and an extended condition. The mandrel in the retracted condition has the distal end retracted from the at least one gate valve. The mandrel in the extended condition is extended through the at least one gate valve, has the distal end engaged with the module, and is configured to communicate the media with the media line.

The module can comprise a hanger configured to support the media line, and the hanger can have an external thread profile configured to install in the wellhead.

The module can comprises a valve being actuatable at least from a closed condition to an opened condition. The valve in the closed condition can be configured to prevent fluid communication through the valve module, while the valve in the opened condition can be configured to allow fluid communication through the valve. The distal end of the mandrel in the extended condition can be configured to actuate the valve from the closed condition to the open condition.

The valve can comprise: a seat affixed in an internal passage of the hanger; a poppet movable in the internal passage between seated and unseated conditions relative to the seat, a tip of the poppet being engageable by the distal end of the mandrel; and a biasing element in the internal passage biasing the poppet to the seated condition.

The mandrel can comprise a valve disposed in the bore, the valve being movable between a closed condition and an opened condition in response to a pressure differential thereacross, the valve in the closed condition being configured to prevent fluid communication through the valve, the valve in the opened condition being configured to allow fluid communication through the valve.

The assembly can comprise a biasing element disposed in the housing and biasing the mandrel to the retracted condition.

The assembly can comprise a mechanism being configured to move the mandrel relative to the housing. For example, the mechanism can comprise: a first gear associated with the housing and being movable; and a second gear associated with the mandrel and being engaged with the first gear. In another example, the mechanism can comprise a hydraulic actuator being configured to move the mandrel with hydraulic pressure communicated to a portion of the housing.

The assembly can be operated by hydraulic pressure. The housing can comprise: a first chamber having the insertion port for the media, and a second chamber having a hydraulic port for the hydraulic pressure. The mandrel can be movable between the retracted condition and the extended condition in response to the hydraulic pressure in the second chamber.

The mandrel can comprise a piston portion sealed in the housing so the mandrel can be movable in the housing in response to the hydraulic pressure in the housing applied against the piston portion. In this example, the housing can comprise a first annular seal disposed in the housing and sealing an annulus between the housing and the mandrel. The first annular seal can separate the housing into the first and second chambers. The second chamber has a first variable volume defined between the first annular seal and the piston portion. In this example, the housing can also comprise a second annular seal disposed in the housing and sealing the annulus between the housing and the mandrel. The distal end of the mandrel in the retracted and extended conditions can be disposed beyond the second annular seal.

In the assembly, the bore of the mandrel in the extended condition can be configured to communicate: hydraulics for the media from the insertion port to a capillary line for the media line supported by the module; an eclectic cable for the media from the insertion port to another electric cable for the media line supported by the module; or an optical cable for the media from the insertion port to another optical cable for the media line supported by the module.

An assembly disclosed herein is operated by hydraulic pressure for fluid injection through a wellhead to a capillary line. The wellhead has at least one gate valve mounted above the wellhead. The assembly comprises: a valve module, a housing, and a mandrel.

The valve module is configured to install in the wellhead and is configured to support the capillary line extending therefrom. The valve module is actuatable from a closed condition to an opened condition. The valve module in the closed condition is configured to prevent fluid communication through the valve module, while the valve module in the opened condition is configured to allow fluid communication through the valve module;

The housing is configured to mount above the at least one gate valve. The housing comprises: a first chamber having an injection port for the fluid injection, and a second chamber having a hydraulic port for the hydraulic pressure. The mandrel is disposed in the housing and defines a bore therethrough from a proximal end to a distal end. The proximal end is exposed in the first chamber. The mandrel is movable between a retracted condition and an extended condition in response to the hydraulic pressure in the second chamber. The mandrel in the retracted condition has the distal end retracted from the gate valve. The distal end of the mandrel in the extended condition is extended through the at least one gate valve and is configured to actuate the valve module from the closed condition to the open condition.

A method is disclosed herein for communicating a media through a wellhead to a communication line in a well. The wellhead has at least one gate valve mounted thereabove. The method comprises: supporting the communication line with a module; installing the communication line and the module through a top of the wellhead; mounting a housing above the at least one gate valve of the wellhead; moving a mandrel disposed in the housing from a retracted condition and an extended condition, a distal end of the mandrel in the retraced condition being retracted from the at least one gate valve; engaging the distal end of the mandrel in the extended condition through the at least one gate valve to the module; and communicating the media from an insertion port in the housing, through a bore of the mandrel, and to the communication line supported by the module.

For example, the method can be used for fluid injection through a wellhead to a capillary line in a well. This method can comprise supporting the capillary line with a capillary hanger; installing the capillary hanger in the wellhead; mounting a housing above the at least one gate valve; moving a mandrel disposed in the housing from a retracted condition and an extended condition, a distal end of the mandrel in the retraced condition being retracted from the at least one gate valve; opening a first valve in the capillary hanger with the distal end of the mandrel in the extended condition being extended through the at least one gate valve to the first valve; and communicating the fluid injection from an injection port in the housing, through a bore of the mandrel, through the open first valve, and into the capillary line.

The foregoing summary is not intended to summarize each potential embodiment or every aspect of the present disclosure.

DETAILED DESCRIPTION OF THE DISCLOSURE

Figure 1:
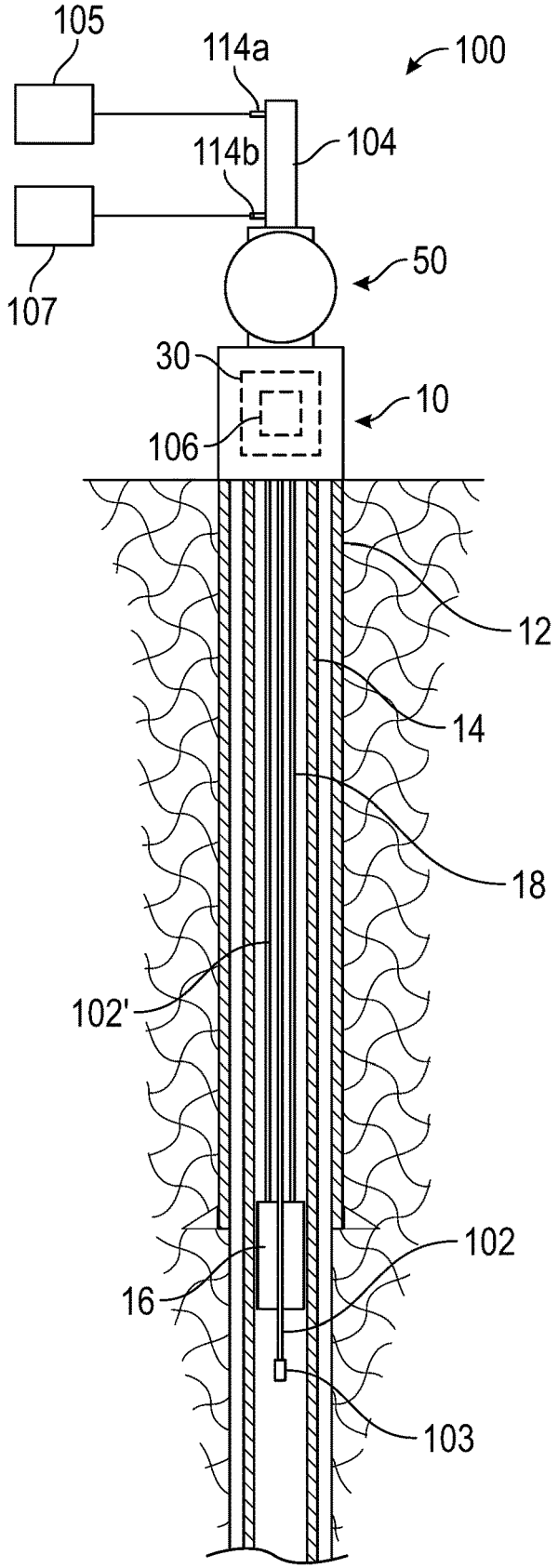
FIG. 1 illustrates a schematic view of a wellhead supporting capillary lines in a well.

FIG. 1 illustrates a schematic view of a wellhead 10 for a well 12. The wellhead 10 includes a casing head 20 having a tubing hanger 30 supported therein. As shown, the tubing hanger 30 can support a tubing string 14 in the well 12 and may support some existing capillary lines 18.

Typically, above the casing head 20, the wellhead 10 has one or more master valves 50, which can be gate valves, to open and close fluid communication of the well 12 for the wellhead 10. Above these, the wellhead 10 may have a flow tee (not shown) with a flow line gate valve (not shown) and a kill line gate valve (not shown) connected to piping and additional components.

During operations, a media line, such as a capillary line, cable, or the like for the well 12 may need to be run downhole in the well 12. For example, an existing capillary line 18 may become clogged, broken, or otherwise become inoperable and may require replacement. In this case, operators may need to run a new capillary line 102 in the well. Alternatively, a new media line 102 may need to be deployed from surface for a particular purpose, such as to connect to downhole equipment or to inject chemicals. In such circumstances, operators will need to run the new media line 102 downhole though the wellhead 10 that is already assembled.

The present example shows several lines run downhole in the well. These lines can be used for a number of purposes. Some of the lines 18 may be existing capillary lines run in the well 12. The existing lines 18 would typically be suspended from an existing tubing hanger 30 inside the wellhead 10. For example, one or more capillary lines 18 can be used as a control line for surface-controlled subsurface equipment 16, such as a hydraulically-actuated downhole tool, a surface-controlled subsurface safety valve (SCSSV), or the like, disposed downhole in the well 12.

Some of the media lines 102, 102' may be newly installed media lines run in the well 12, which are run through the existing master valve 50 and other components of the wellhead 10. If an existing capillary line 18 becomes inoperable, for example, a new media line 102' in the form of a hydraulic control line may need to be run downhole from the wellhead 10. In another example, a new media line 102 can be used as an injection line for injecting chemicals to downhole into the well 12. Chemicals from a chemical injection manifold 105 are injected down the capillary line 102 to a chemical injection valve 103 in the well. The chemical injection can be used to reduce corrosion in the well, to reduce buildup of wax and scale in the well, to enhance production, and the like. The media lines 18, 102, 102' for the wellhead 10 can be used for these and other purposes known in the art.

Simply running a media line from a top cap of the wellhead 10 through the gate valve(s) 50 and other components of the wellhead 10 is not suitable in most cases. To run a media line on the existing wellhead 10, operators would typically need to add a new tubing spool to the wellhead 10, may need to modify or change out the lower master gate valve 50 on the wellhead 10, may need to perform a hot-tap in the wellhead 10, or may need to conduct some other remedial action, which can be cumbersome and complicated. Put simply, disassembling, moving, or changing parts of the existing wellhead 10 may not be desired in many instances.

In contrast to the typical remedial actions, a well connect assembly 100 of the present disclosure is instead used on the wellhead 10. The well connect assembly 100 installs on the wellhead 10 so the assembly 100 can support a media line 102 or 102' and can allow operators to perform fluid injection, communicate hydraulics, make electrical or optical connections, or perform other appropriate operation. The media line 102 or 102' may be newly deployed in the well or may be already installed. For example, the well connect assembly 100 can support a capillary line for the media line 102 so operators can perform chemical injection. In another example, the well connect assembly 100 can support a hydraulic control line for the media line 102' so hydraulic communication can be made to subsurface equipment 16. In yet another example, the well connect assembly 100 can support an electric or optical cable for the media line 102' so electric or optical communication can be made to subsurface equipment 16. Examples that follow will primarily describe an arrangement in which the well connect assembly 100 supports a capillary line for the media line 102 so operators can perform chemical injection.

As briefly shown in FIG. 1, the well connect assembly 100 includes an injection module 104 and a valve module 106. The valve module 106 supports the capillary line 102 and is installed in the wellhead 10 below the gate valve(s) 50. For example, the valve module 106 can install in the tubing hanger 30 of the wellhead 10 in an operation similar to that used to install a backpressure valve in a tubing hanger 30. Suitable equipment, such as a running tool, polished rod, and the like can be used to install the valve module 106.

As shown in FIG. 1, the wellhead 10 has a lower master gate valve 50 installed on the casing head 20, and the injection module 104 mounts above the master gate valve 50 on the wellhead 10. If an upper master valve (not shown), a flow tee (not shown), and the like are present, these components can remain on the wellhead 10, and the injection module 104 is mounted on top of the wellhead 10 at the top cap.

With the assembly 100 installed, an actuation device 107 actuates the assembly 100. For example, the actuation device 107 can be a hydraulic (or pneumatic manifold that communicates hydraulics (or pneumatics) to a hydraulic port 114*b* on the injection module 104 to actuate the assembly 100. While the assembly 100 is actuated, an injection manifold 105 injects chemicals, hydraulics, or other intended fluid into an injection port 114*a* of the injection module 104, which can communicate down the assembly 100, through the gate valve 50, and to the valve module 106 installed in the tubing hanger 30. The valve module 106 can then communication the fluid injection further through the supported capillary line 102 in the well 12.

As can generally be seen, the well connect assembly 100 allows for a fluid connection to be made at surface to downhole in a well 12 without the need to add a tubing spool to the wellhead 10, without the need to convert the master gate valve 50, and without the need to perform other cumbersome or time-consuming operations. All the while, the wellhead 10 is protected from surface backpressure from the well 12, and the well connect assembly 100 can be deactivated to maintain well integrity.

Figure 2A:
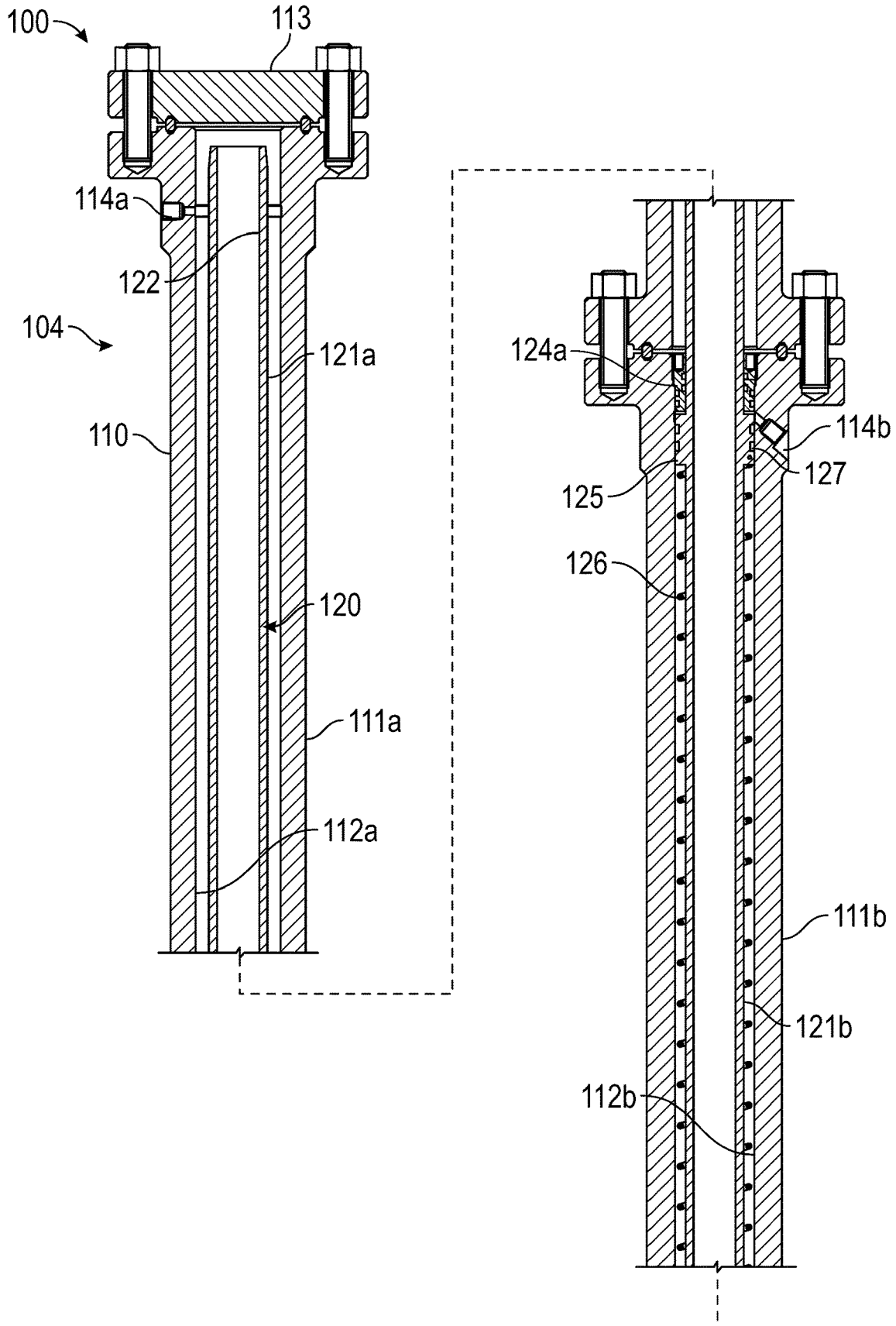
FIGS. 2A-2B illustrate a cross-sectional view of a well connect assembly of the present disclosure in an initial operational stage.
Figure 2B:
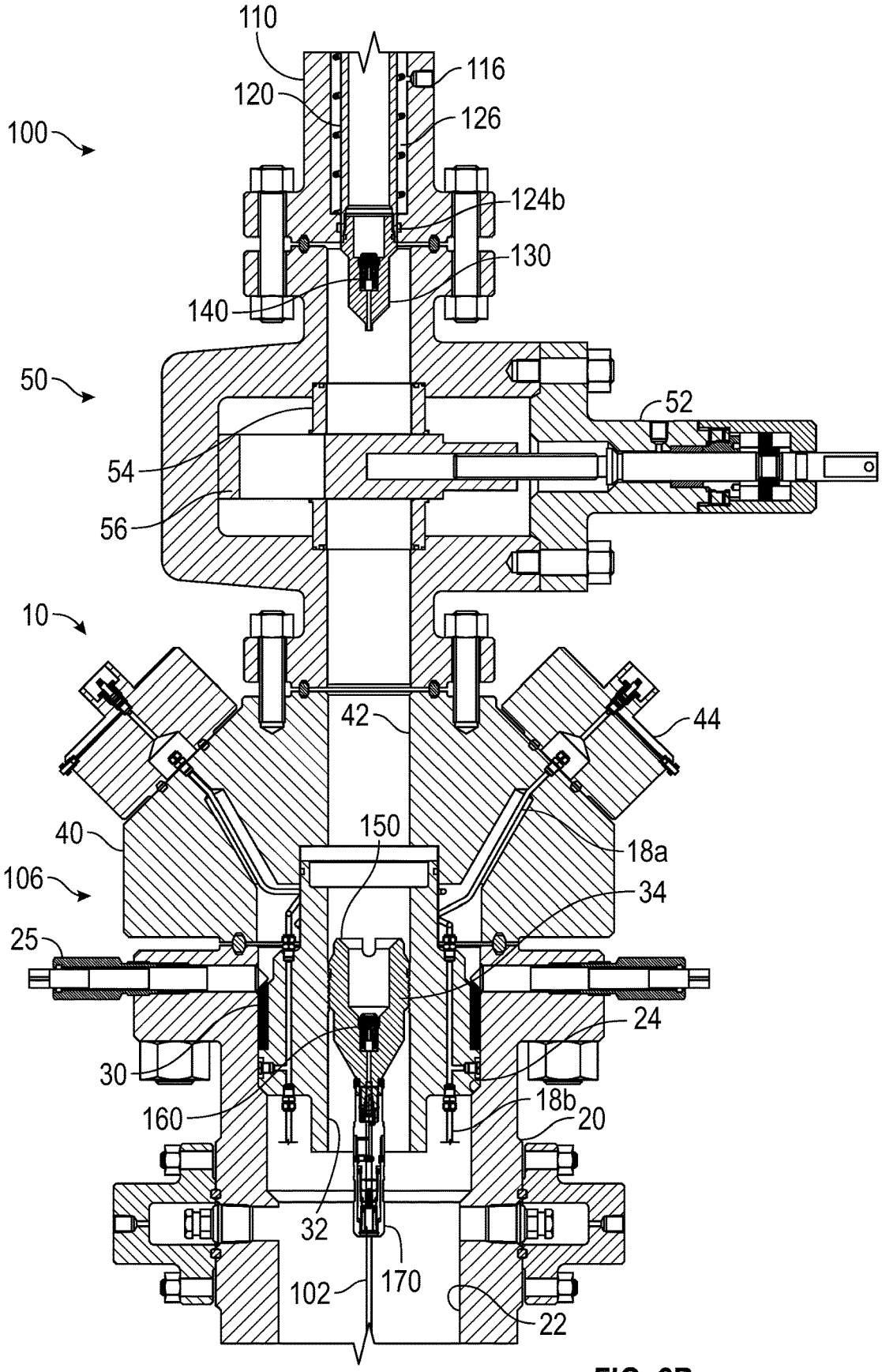

Having a general understanding of the well connect assembly 100, discussion turns to FIGS. 2A-2B, which illustrate cross-sectional views of a well connect assembly 100 of the present disclosure that is hydraulically-actuated.

FIG. 2A shows a majority of an injection module 104 of a well connect assembly 100, while FIG. 2B shows a remaining portion of the injection module 104 and shows a valve module 106 in the wellhead 10. As shown in FIG. 2A, the injection module 104 includes a housing 110 and an internal mandrel 120, which is movable in the housing 110.

As shown in FIG. 2B, the housing 110 of the injection module 104 couples atop the wellhead 10, which can have a number of different components. These components may be existing on the wellhead 10 and would depend on the existing implementation. Here, the wellhead 10 includes a casing hanger 20, a tubing hanger 30, a spool adapter 40, and a lower master gate valve 50. Other implementations may have different components for the wellhead 10 than shown here.

The casing head 20 has the tubing hanger 30 landed in a landing bowl 24 of the head bore 22. Lock screws 25 can retain the tubing hanger 30 in place. For its part, the tubing hanger 30 can support a tubing string (not shown) in the well and may support capillary control lines 18*b*.

The adapter 40 is attached to the casing hanger 20 and has an adapter bore 42 that communicates with the hanger bore 32. In this example, hot-tap modules 44 are attached to the adapter 40 to provide access to connector lines 18*a* that run from the adapter 40 to the tubing hanger 30. These lines 18*a* can communicate through passages in the tubing hanger 30 to the existing control lines 18*b* supported by the tubing hanger 30. Other implementations are possible.

The lower gate valve 50 is attached to the adapter 40. As is typical, the gate valve 50 includes a bonnet actuator 52 that can move a gate 56 inside the valve 50 relative to gate seals 54 to open or close fluid communication through the valve 50. As shown in FIG. 2B, the lower end of the injection housing 110 of the well connect assembly 100 is attached above the gate valve 50 in this example.

Returning to FIG. 2A, the injection housing 110 can include an upper spool 111*a* that connects to a lower spool 111*b* and can include a top cap 113 to enclose the inside of the housing 110. The modular configuration facilitates assembly, but other configurations for the housing 110 can be used.

The housing 110 includes an injection chamber 112*a* separated from a hydraulic chamber 112*b* by an annular seal 124*a*, which seals against the internal mandrel 120. (FIG. 5 discussed below shows details of the annular seal 124*a*.) The internal mandrel 120 is movably disposed in the housing 110 against the bias of a return spring 126 or other biasing element. For example, the spring 126 is a compression spring disposed in the housing 110. An upper end of the spring 126 fit against a shoulder of a piston portion 125 of the mandrel 120, and a lower end of the spring 126 as shown in FIG. 2B fits against a shoulder in the housing 110. Other biasing arrangements can be used.

As best shown in FIG. 2A, the mandrel 120 defines a flow bore 122 therethrough from a proximal end to a distal end. Additionally, the mandrel 120 includes a first (upper) flow tube portion 121*a* at the proximal end and includes a second (lower) flow tube portion 121*b* at the opposite distal end. The piston portion 125 is disposed between the flow tube portions 121*a*-*b* and has an annular seal 127 that slideably seals in the housing 110.

The housing 110 includes an insertion or injection port 114*a* for insertion or injection of media, chemicals, hydraulics, or the like into the injection chamber 112*a*. Likewise, the housing 110 includes a hydraulic port 114*b* for introducing hydraulic fluid into the hydraulic chamber 112*b*. Meanwhile, the annular seal 124*a* keeps the injection fluid in the injections chamber 112*a* separate from the hydraulic fluid in the hydraulic chamber 112*b*.

The hydraulic chamber 112*b* is a variable volume defined between the annular seal 124*a* and the piston portion 125 with its seals 127. Increasing hydraulic pressure in the hydraulic chamber 112*b* applies force on the piston portion 125 to move the mandrel 120 down in the housing 110 against the bias of the spring 126. Reduction in the hydraulic pressure in the hydraulic chamber 112*b* and the return bias of the spring 126 can move the mandrel 120 to its retracted position up in the housing 110.

As shown in FIG. 2B, the distal end of the mandrel 120 includes a stinger 130, which can have a check valve 140. As also shown in FIG. 2B, the valve module 106 of the well connect assembly 100 includes a capillary hanger 150 and a valve 160. The capillary hanger 150 is installed in a back-pressure valve (BPV) profile 34 of the tubing hanger 30. For example, an external thread profile 154 on the capillary hanger 150 can thread into the threaded BPV profile 34 of the tubing hanger 30. A seal ring 155 on the capillary hanger 150 can seal against the inner bore 32 of the hanger 30.

The capillary hanger 150 supports a capillary line 102 using a connector 170. The valve 160 is disposed in the capillary hanger 150 and controls fluid communication with the capillary line 102. In particular, the valve 160 is a no-return valve, a check valve, a poppet valve, or the like that prevents fluid communication from downhole to uphole (i.e., prevents backpressure from the well) and that allows fluid communication from uphole to downhole (i.e., allows the fluid injection to pass to the capillary line 102). (FIGS. 4 and 6 discussed below shows details of the capillary hanger 150 and the check valve 160.)

In FIGS. 2A-2B, the well connect assembly 100 is shown in an initial operational stage on the wellhead 10 before injection is performed. The gate valve 50 is closed, and the mandrel 120 is retracted to a retracted position in the housing 110. In this position, the stinger 130 on the distal end of the mandrel 120 is retracted from the gate 56 and seals 54 of the gate valve 50 so the gate valve 50 can function as normal. In contrast, the well connect assembly 100 in FIGS. 3A-3B is shown in a subsequent operational stage on the wellhead 10 for injection to be performed.

Figure 3A:
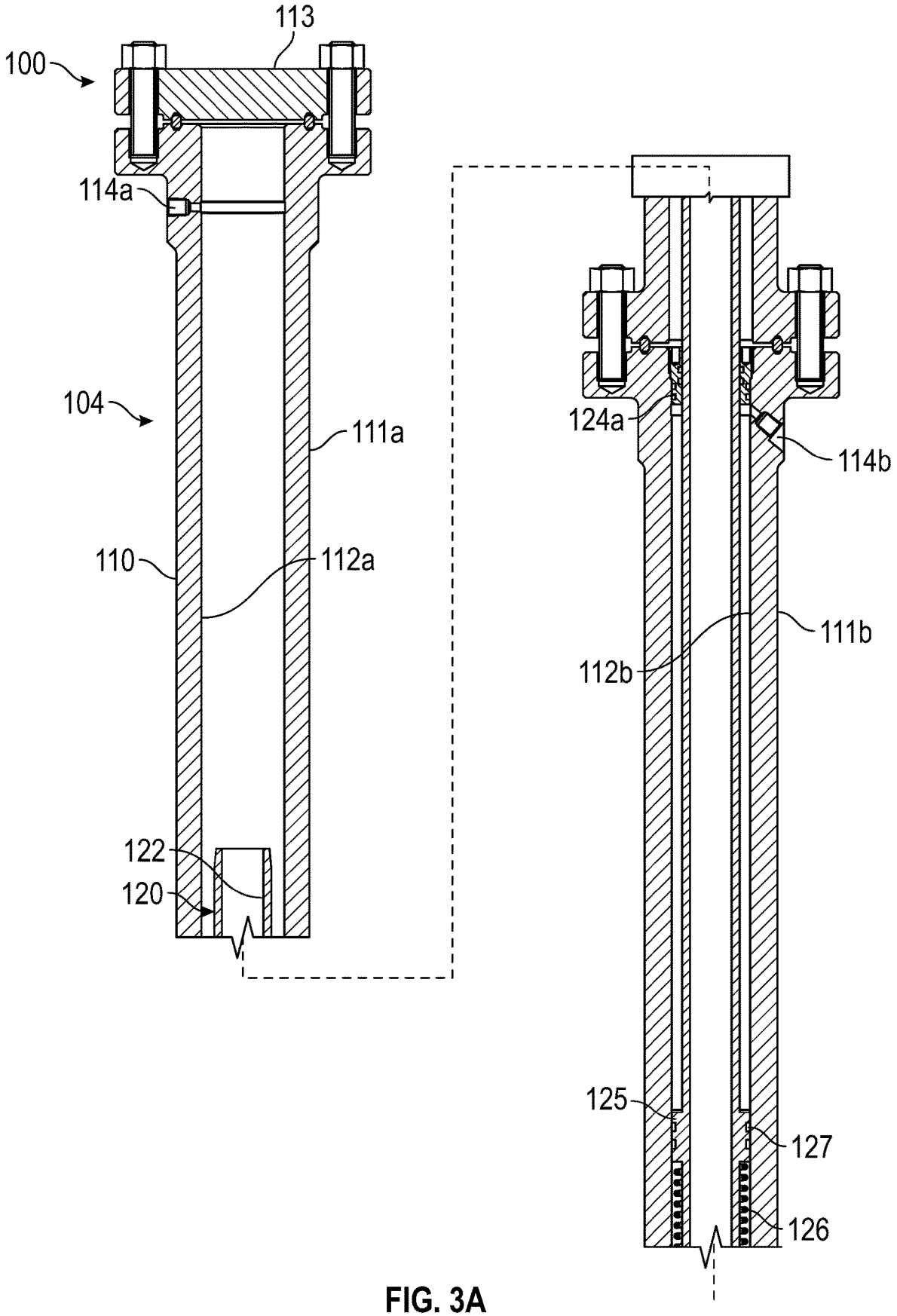
FIGS. 3A-3B illustrate a cross-sectional view of the well connect assembly of the present disclosure in a subsequent operational stage.
Figure 3B:
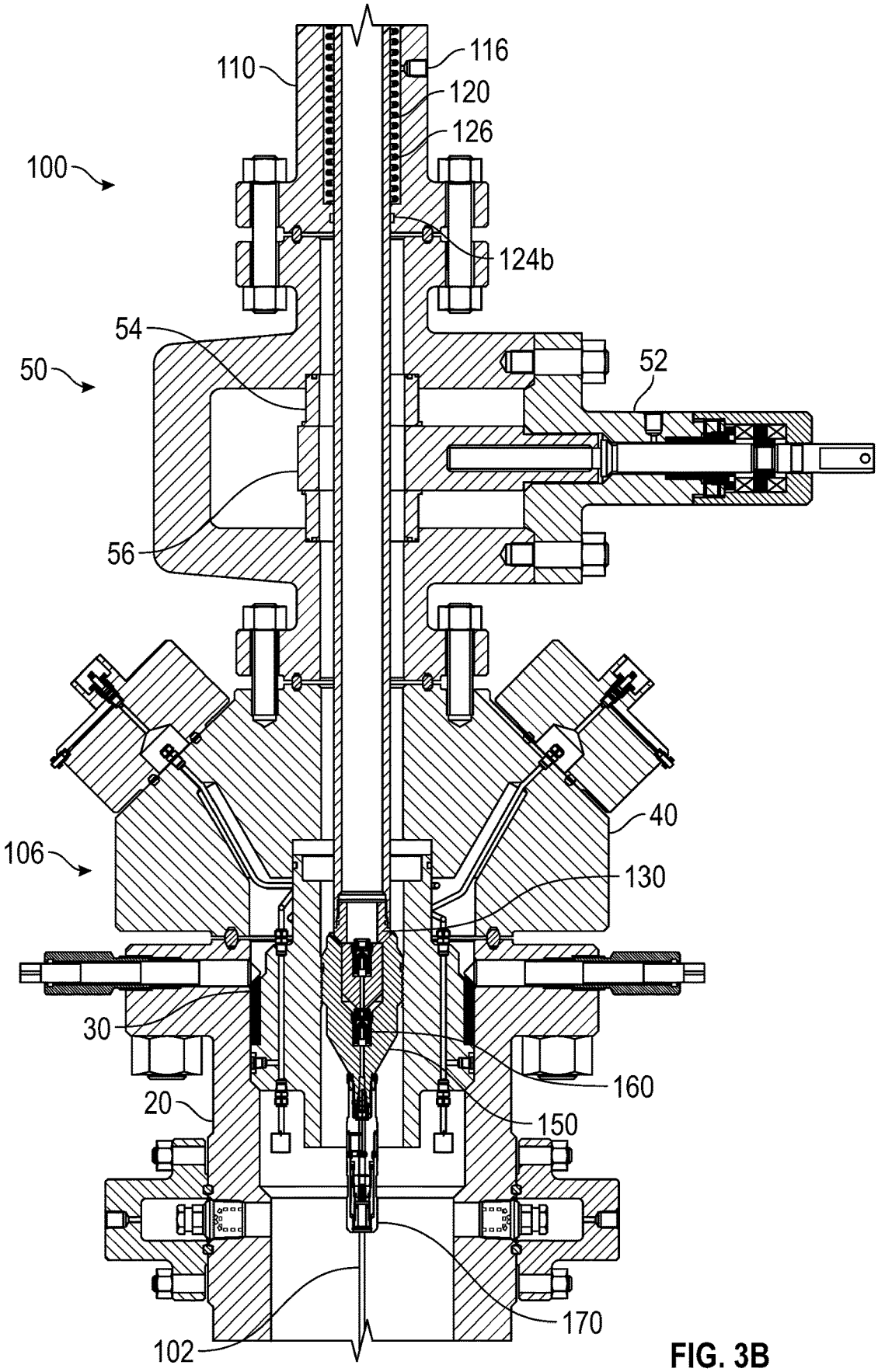

To initiate injection operations, the gate valve 50 is opened so that the opening in the gate 56 aligns with the gate seals 54, as shown in FIG. 3B. The check valve 140 on the stinger 130 can prevent well fluids from entering the bore 122 of the mandrel 120. Additionally, the check valve 160 on the capillary hanger 150 can prevent well fluids from entering above the tubing hanger 30.

As shown in FIGS. 3A-3B, hydraulic pressure at the hydraulic port 114*b* pumps the retractable mandrel 120 down in the housing 110, through the open gate valve 50, and into the tubing hanger 30. The stinger 130 on the end of the mandrel 120 stings into the capillary hanger 150 and opens the check valve 160. Injection fluid (e.g., chemicals, hydraulics, or the like) for the fluid injection are pumped into the injection chamber 112*a* from the injection port 114*a*. The injected fluid can now pass through the mandrel's bore 122, through the open check valve 160, and through the capillary hanger 150 to be conveyed via the capillary line 102 further downhole.

For the injection operation, the mandrel 120 is moved so the mandrel's bore 122 is connected in fluid communication to the capillary line 102 supported in the wellhead 10. In the current examples, hydraulics drive down the mandrel 120 to make the connection. Other forms of actuation can drive the mandrel 120 down to make the connection. For example, pneumatic actuation as briefly mentioned above can drive the mandrel 120 to make the connection. In other example, a mechanical form of actuation having a motor, screw rod, gears, etc. using electricity, hydraulics, pneumatics, or the like for power can be used to drive the mandrel 120.

Hydraulic actuation may be preferred for most implementations because the well connect assembly 100 can operate similar to a safety valve. If hydraulic pressure is lost (e.g., the hydraulic manifold fails, power is lost, etc.), the return spring 126 can retract the mandrel 120 in a fail-safe to stop injection when the hydraulic pressure drops in the hydraulic chamber 112*b*. The hydraulic manifold (105) connected to the hydraulic port 114*b* can be tied into or can be part of other systems at the wellsite, such as a shut-down system, which is used to shut in the well by closing the gate valve 50. Should the shut-down system detect the need for shut in due to pressure measurements or the like, then the hydraulic manifold (105) can release hydraulic pressure in the chamber 112*b* so the manifold 120 retracts by operation of the spring 160, allowing the gate valve 50 to be shut.

As further shown in FIG. 3B, a lower annular seal 124*b* seals the annulus between the housing 110 and the lower flow tube portion 121*b* of the mandrel 120. This seal 124*b* can prevent well fluids from entering the second variable volume on the other side of the piston portion 125 where the spring 126 is located. Well pressure in this volume would act against the operation of the piston 125. A vent port 116 can allow this volume to be evacuated. Also, if feasible, the port 116 could be used to hydraulically raise the mandrel 120 by having hydraulic fluid injected into the second variable volume between the piston portion 125 and the lower annular seal 124*b* while venting the first variable volume from the hydraulic port 114*b*.

Figure 4:
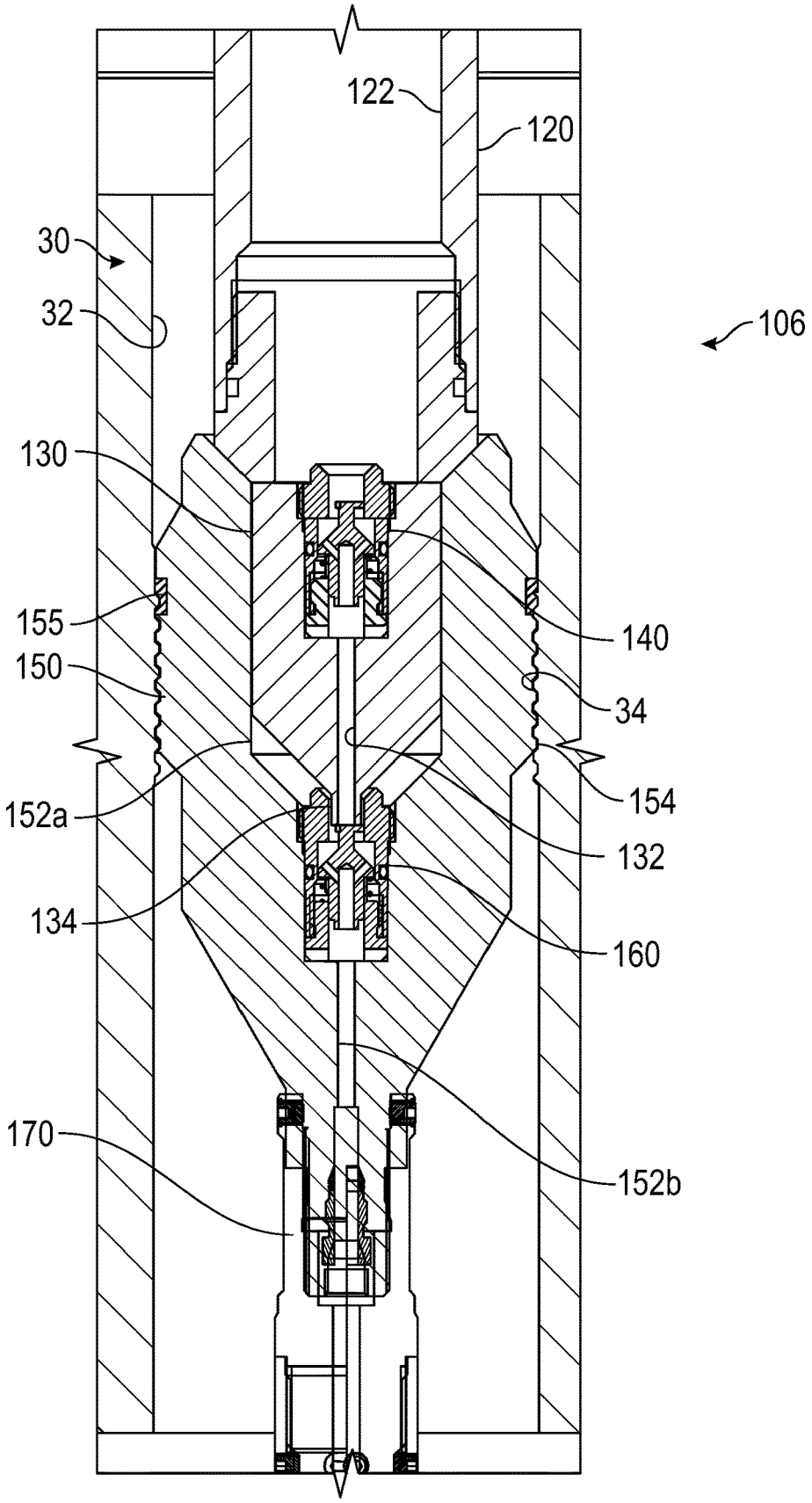
FIG. 4 illustrates a detailed cross-sectional view of a stinger engaged with a capillary hanger of the well connect assembly.

FIG. 4 illustrates a detailed cross-sectional view of the stinger 130 and the capillary hanger 150. The stinger 130 is shown disposed on the distal end of the mandrel 120 and includes a mandrel check valve 140 for controlling fluid communication with the mandrel's bore 122. The capillary hanger 150 is installed in the BPV profile 34 of the tubing hanger 30 and includes a hanger check valve 160. The stinger 130 is stung into a receptacle 152*a* of the capillary hanger 150, and a distal tip 134 of the stinger 130 engages the check valve 160 of the capillary hanger 140. Injected fluid from the mandrel's bore 122 can open the mandrel check valve 140, can pass into the stinger passage 132, can pass through the opened hanger check valve 160, and can pass into the hanger passage 152*b* so the injected fluid can pass into the connector 170 of the capillary line (not shown).

Should the injection pressure in the mandrel's bore 120 fall below a predetermined level, the mandrel's check valve 140 will close, preventing back flow of fluids. Should the stinger 130 be unstung from the hanger's check valve 140 due to a reduction in hydraulic pressure against the mandrel 120, the hanger's check valve 140 will close, preventing back flow of fluids.

Figure 5:
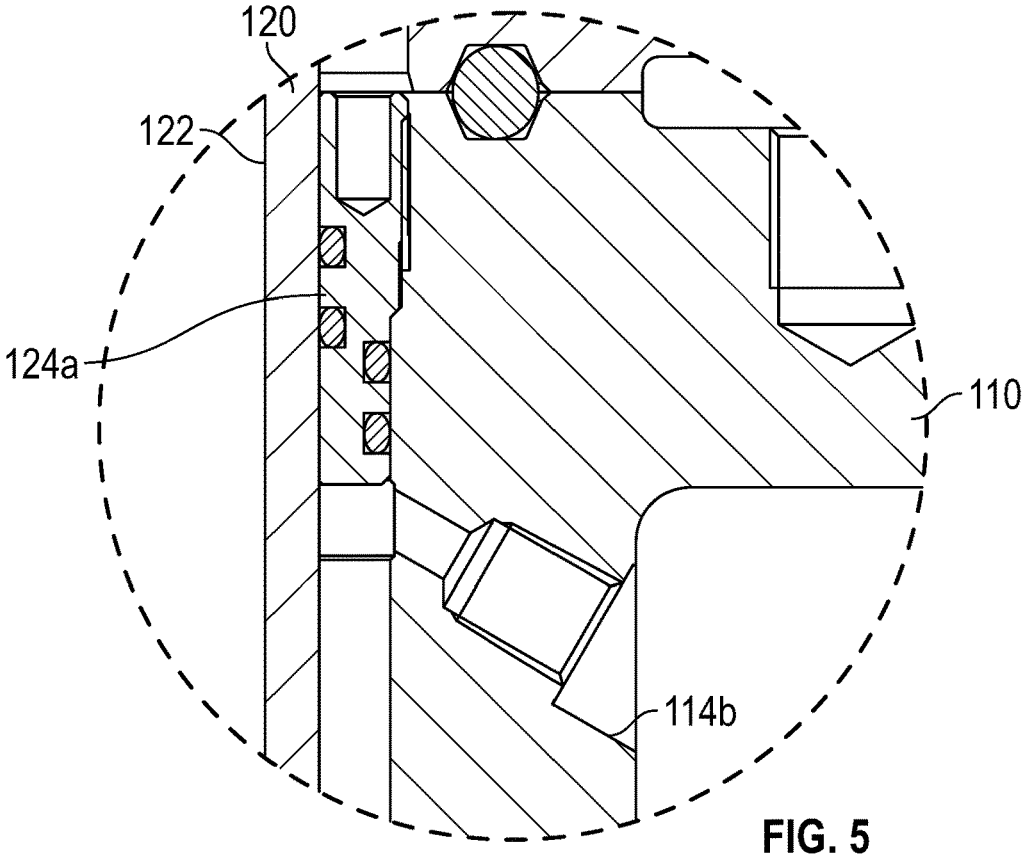
FIG. 5 illustrates a detailed cross-sectional view of an annular seal of the well connect assembly.

FIG. 5 illustrates a detailed cross-sectional view of the annular seal 124*a* separating the chambers 112*a*-*b* of the injection housing 110 and sealing against the outer surface of the mandrel 120. The annular seal 124*a* can be a gland seal thread into the mandrel's housing 110, and the annular seal 124*a* can have inner and outer annular seal elements for sealably engaging between the housing 110 and the mandrel 120. The inner seal elements of the annular seal 124*a* preferably allow for sliding sealing with the surface of the mandrel 120, which is movable in the housing 110.

Figure 6:
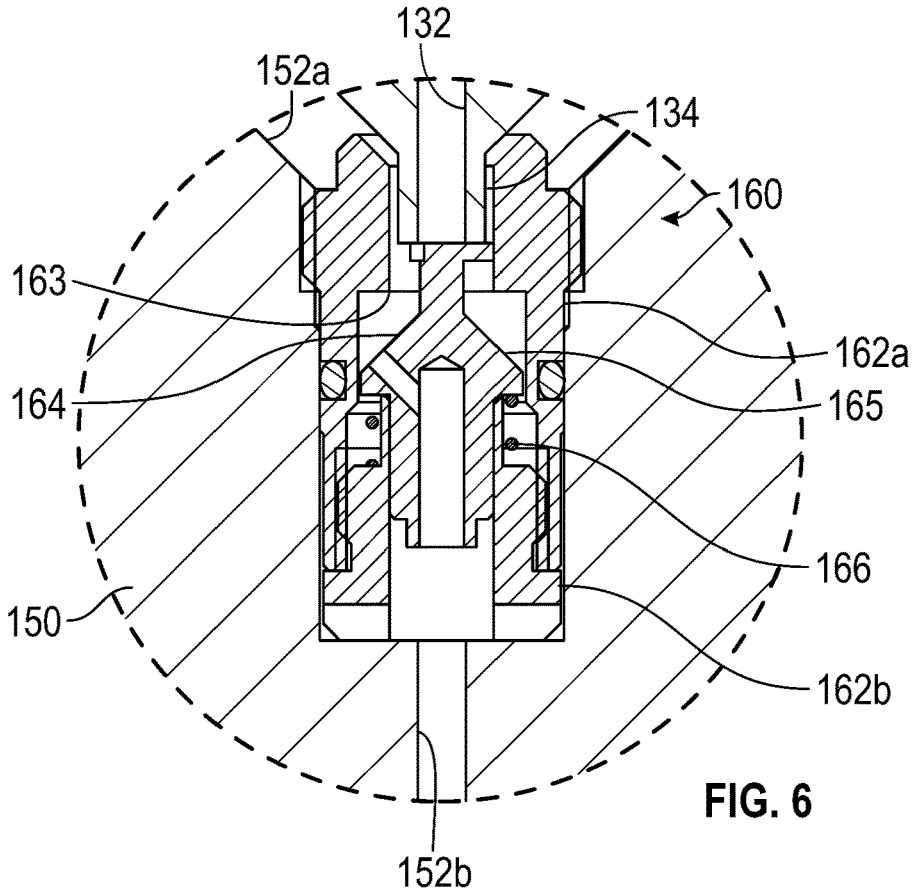
FIG. 6 illustrates a detailed cross-sectional view of a valve for the well connect assembly.

FIG. 6 illustrates a detailed cross-sectional view of the check valve 160 for the capillary hanger 150. The check valve 160 in this example is a poppet valve, but other types of valves can be used. A lower retainer 162*b* fits into the receptacle 152*a* of the hanger 150, and an upper retainer 162*a* affixes in the receptacle 152*a* to hold a poppet 164 therein. A spring 166 biases the poppet 164 toward a seat 163 in the retainer 162*a* to seal off fluid communication from the hanger passage 152*b* up through the check valve 160. When the distal tip 134 of the stinger 130 pushes against the poppet 164, the poppet 164 unseats from the seat 163 and exposes bypass ports 165 in the poppet 164. Fluid can now communicate through the open check valve 160. Although not shown here, the check valve (140) for the stinger 130 may be comparably configured.

Figure 7:
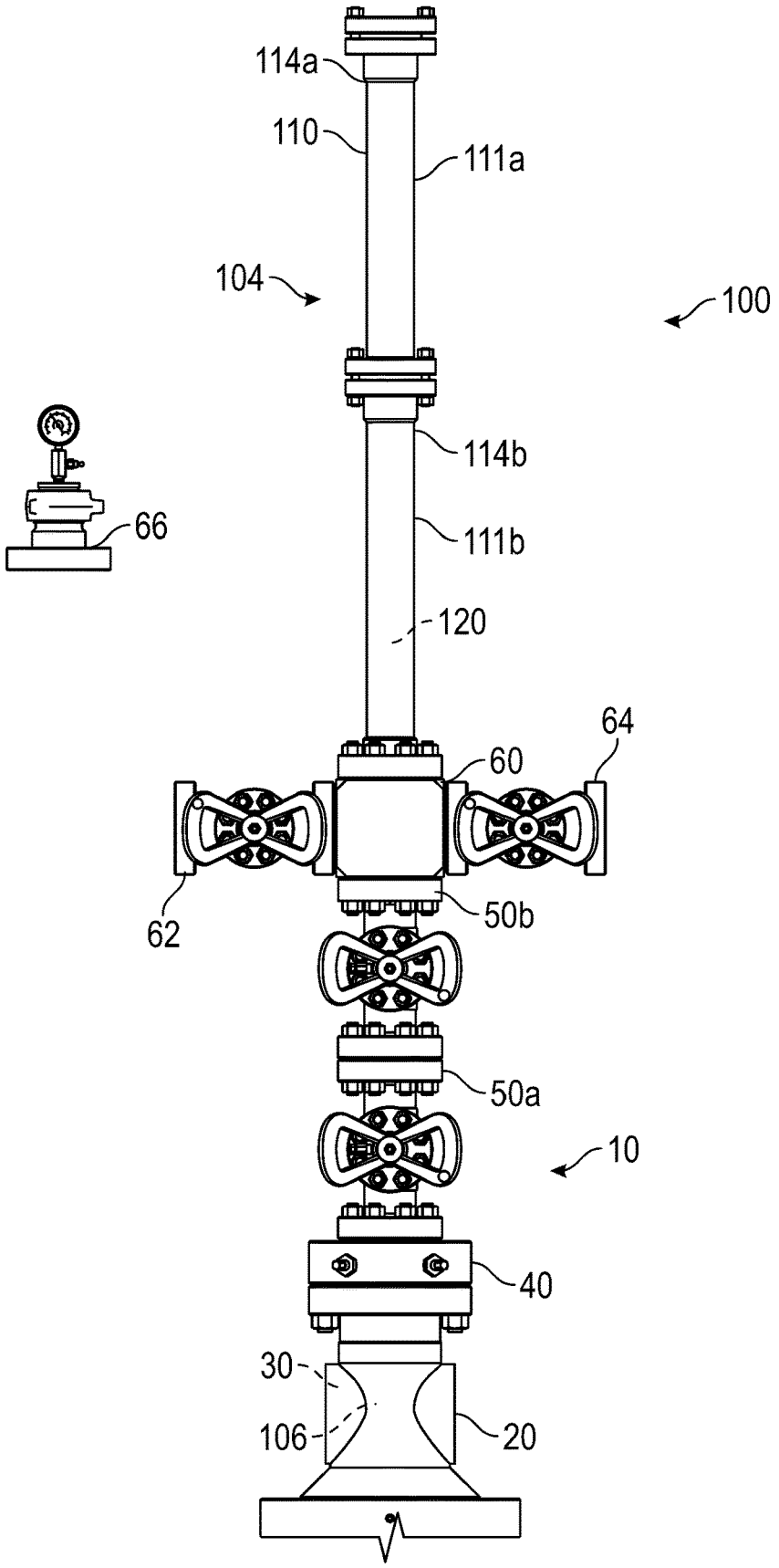
FIG. 7 illustrates the well connect assembly installed on another wellhead implementation.

As noted above, the well connect assembly 100 can be used with wellheads of different configurations. FIG. 7 illustrates the well connect assembly 100 installed on another wellhead implementation. Here, the wellhead 10 is a production tree that includes a tubing head adapter 40 connected to a tubing head 20. Lower and upper master valves 50*a-b* connect above the adapter 40, and a studded cross 60 mounts to the top of the upper master gate valve 50*b*. As is typical, a flow line gate valve 62 and a kill line gate valve 64 connect to opposite sides of the studded cross 60, and the gate valves 62 and 64 connect to additional components (e.g., piping, chokes, etc.).

The master gate valves 50*a-b* can be opened and closed to control flow for the wellbore. The flow line and kill line gate valves 62, 64 are used to control the flow line and kill lines (not shown). The top cap 66 can be removed to provide access to the wellbore for various operations. For example, a capillary line (not shown) connected the valve module 106 can be installed through the wellhead 10 using standard procedures, and the valve module 106 can be installed in a tubing hanger 30 in the casing hanger 20. The well connect assembly 100 can then connect to the top of the studded cross 60 in place of the top cap 66.

The well connect assembly 100 can operate as before. In the retracted position, the mandrel 120 is retracted from the gate valves 50*a-b*. In the extended position, the mandrel 120 is extended through the open gate valves 50*a-b* to the valve module 106 (having the capillary hanger 150 and check valve 160) installed in the tubing hanger 30 of the wellhead 10.

Figure 8:
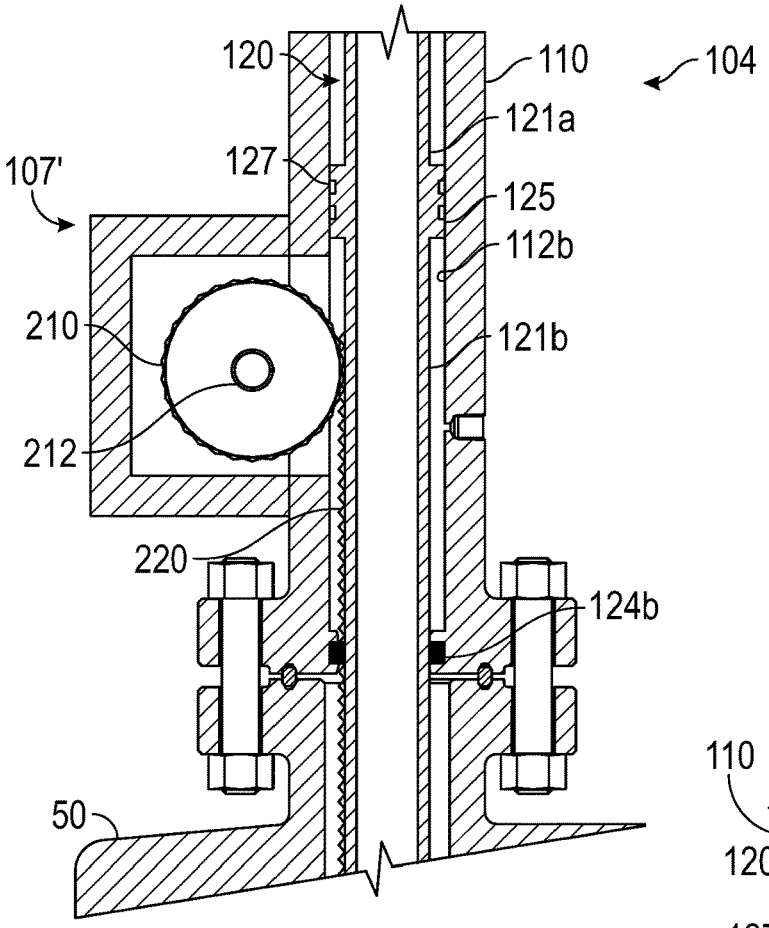
FIG. 8 illustrates a portion of the well connect assembly having an alternative actuator arrangement.

As noted above, the well connect assembly 100 of the present disclosure may be hydraulically actuated, but other forms of actuation can drive the mandrel 120 down to make the connection. For example, a mechanical form of actuation having a motor, screw rod, gears, etc. could be used to drive the mandrel 120. FIG. 8 is an example of one such mechanical arrangement for an actuation device 107'. The rest of the components of the injection module 104 can be the same as before.

The housing 110 includes an opening, pocket, enclosure, etc. for a pinion gear 210 exposed in the lower chamber 112*b*. The mandrel 120 includes a rack gear 220 along a portion of its length for engagement with the pinion gear 210. A motor (not shown) for the actuator device 107', which can be hydraulic, pneumatic, electric, or the like, can rotate the pinion gear 210 to lower the mandrel 120 to extend the mandrel 120 to its extended condition to make the fluid connection. The motor for the actuator device 107' can reverse the rotation to raise the mandrel 120 to its retracted condition, or a torsion spring (not shown) on the pinion gear 210 can reverse the rotation of the pinion gear 210 upon release of the motor or a clutch arrangement. Appropriate sealing is used for the housing 110 to seal the pinion gear 210 and the rack gear 220. For example, a rotary seal 212 can be provided for the pinion gear 210, and a glandular seal 124*b* can be used between the housing 100 and the mandrel 120 to seal the rack gear 220.

Figure 9:
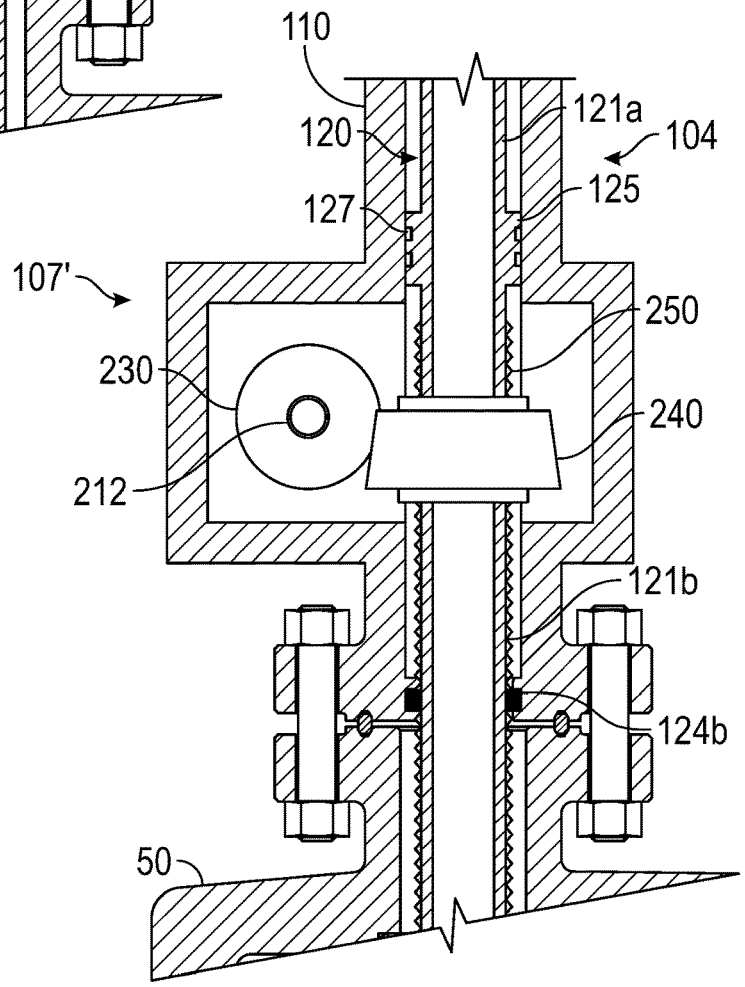
FIG. 9 illustrates a portion of the well connect assembly having another alternative actuator arrangement.

FIG. 9 is an example of another mechanical arrangement of an actuation device 107' in the form of a worm gear screw jack. The housing 110 includes an opening, pocket, enclosure, etc. for a worm 230 engaged with a worm gear 240 exposed in the lower chamber 112*b*. The mandrel 120 includes a screw gear 250 along a portion of its length for engagement with a threaded interior of the worm gear 240. A motor (not shown) for the actuator device 107', which can be hydraulic, pneumatic, electric or the like, can rotate the worm 230, which rotates the worm gear 240 to translate the mandrel 120 to extend the mandrel 120 to its extended condition to make the fluid connection. The motor for the actuator device 107' can reverse the rotation to raise the mandrel 120 to its retracted condition, or a torsion spring (not shown) on the worm 230 can reverse the rotation of the worm gear 240 upon release of the motor or a clutch arrangement. Appropriate sealing is used for the housing 10 to seal the worm 230 and the screw gear 250. For example, a rotary seal 212 can be provided for the worm 230, and a glandular seal 124*b* can be used between the housing 100 and the mandrel 120 to seal the screw gear 230.

As will be appreciated, bearings, shafts, sleeves, and other necessary features are not shown in FIGS. 8 and 9. These and other forms of mechanical configurations can be used.

As noted above, the well connect assembly 100 can be used for communicating hydraulics and chemicals through the wellhead 10, but other forms of media can be communicated by the well connect assembly 100 through the wellhead 10. For example, physical connections for electrical and optical communications can also be achieved using the disclosed assembly 100.

Figure 10A:
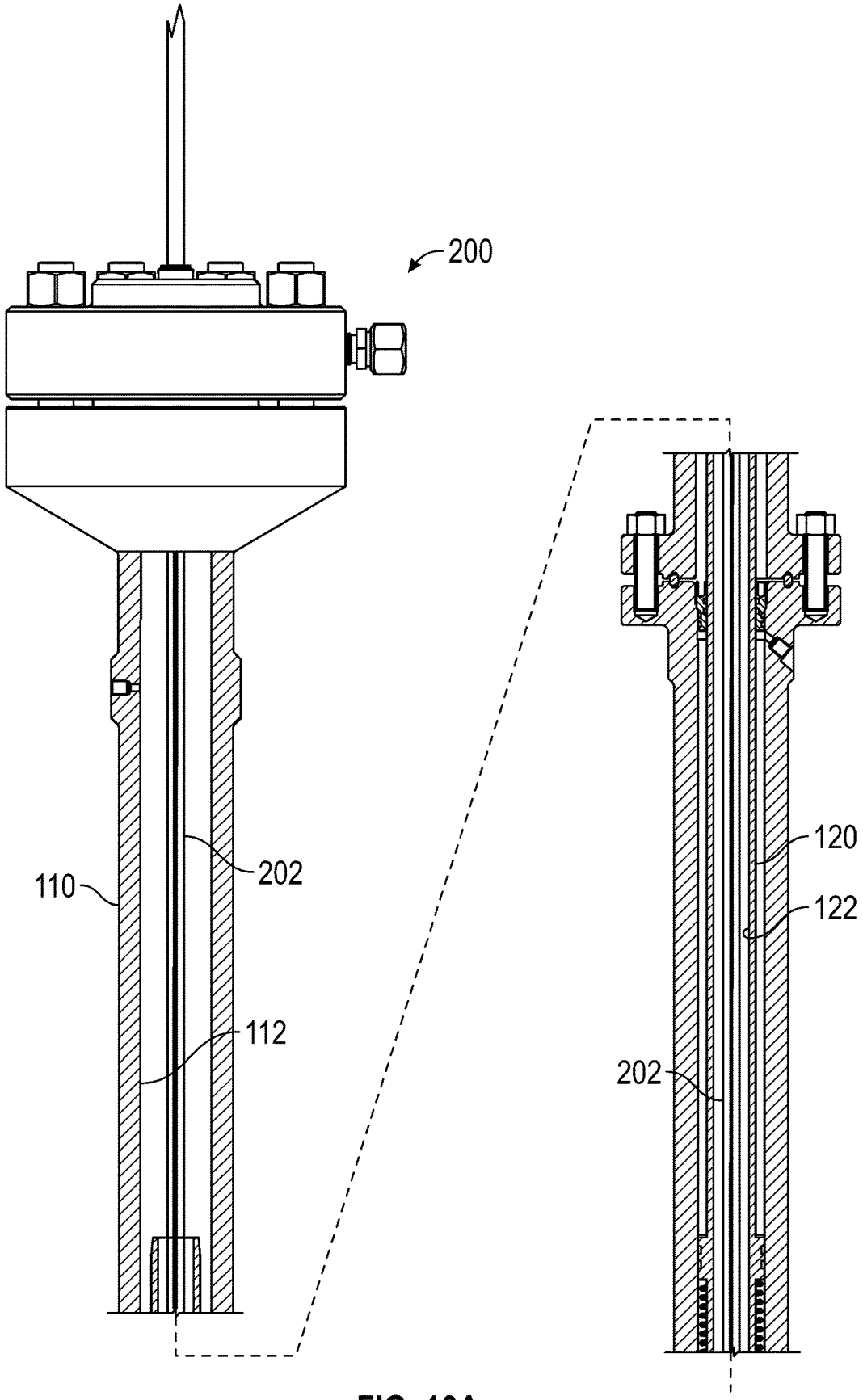
FIGS. 10A-10B illustrate a cross-sectional view of another well connect assembly of the present disclosure in an operational stage.
Figure 10B:
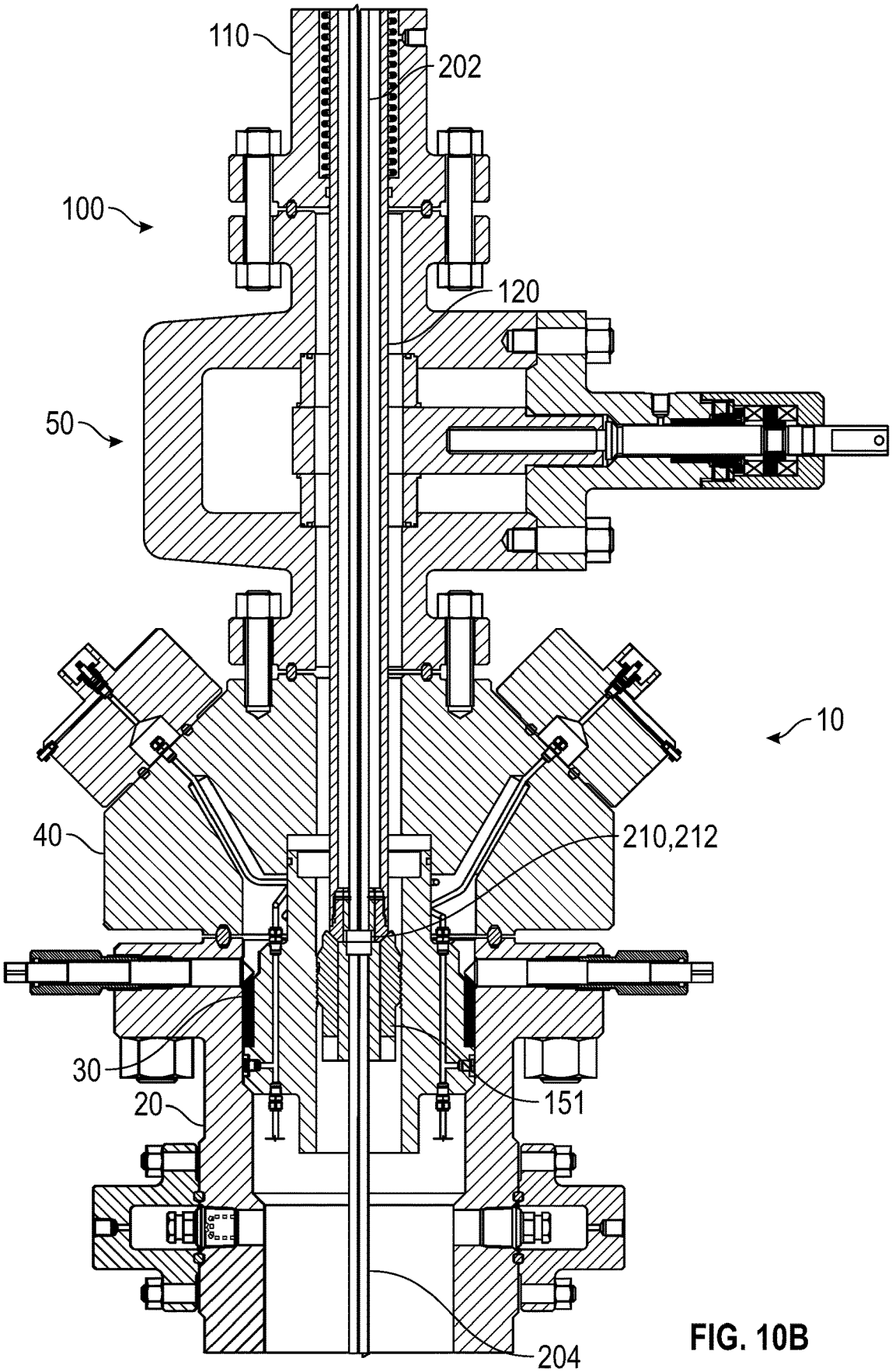

FIGS. 10A-10B show an example of the well connect assembly 100 providing a connection for electrical and optical communications according to the present disclosure. The assembly 100 includes components similar to other embodiments discussed above so the same reference numerals are used for similar components. As shown here, the housing 110 mounted on the wellhead 10 includes an insertion port for inserting the media, namely an insertion assembly 200 for inserting a capillary line, electrical cable, fiber optics cable, or other type of media line into the housing 110. The insertion assembly 200 can include a stuffing box, packing glands, hangers, couplings, and other components used in the art. The media lines 202/204 can include a cable used for a deployed electric submersible pump (ESP) system. In another example, the media lines 202/204 can be used to run fiber optic lines downhole to a thru-tubing fibre optic reservoir monitoring system or the like.

In a simple arrangement, a media line 202 can be inserted through the insertion assembly 200 and can be run down through the mandrel 120 that is stung into the tubing hanger 130. If a back-pressure valve (not shown) is present in the tubing hanger 30, the media line 202 can pass through and open the valve. From there, the media line 202 can be run further downhole from the wellhead 10. Should the mandrel 120 be retracted, however, the media line 202 would remain passing through the gate valve 50. The media line 202 would need to be retrieved or broken for the gate valve 50 to close.

In another arrangement, a media line 202 can be inserted through the insertion assembly 200 to make a connection to another media line 204 supported on a hanger 151 in the wellhead 10. A coupling 210, for example, on the end of the media line 202 can make a connection to another coupling 212 for the media line 204 supported on the hanger 151. The coupling 210 may be supported at the distal end or stinger of the mandrel 120 so the connection can be made as the mandrel 120 is moved and stung into the hanger 151.

The mandrel 120 can be driven as before so that the distal end stings into the hanger 151, as shown in FIG. 10B. This stinging can open a one-way valve (not shown), such as a flapper valve or other type of valve, on the hanger 151 if present. The media line 202 from the well connection assembly 100 can thereby connect with the media line 204 in the well through the connection of the couplings 210, 212.

Should the mandrel 120 be withdrawn for this arrangement, the media line 202 passed through the stuffing box 200 can be unconnected from the hanger 151 at the couplings 210, 212, and the media line 202 can be moved up through the gate valve 50 with the retraction of the mandrel 120.

Figures 11A, 11B, 11C:
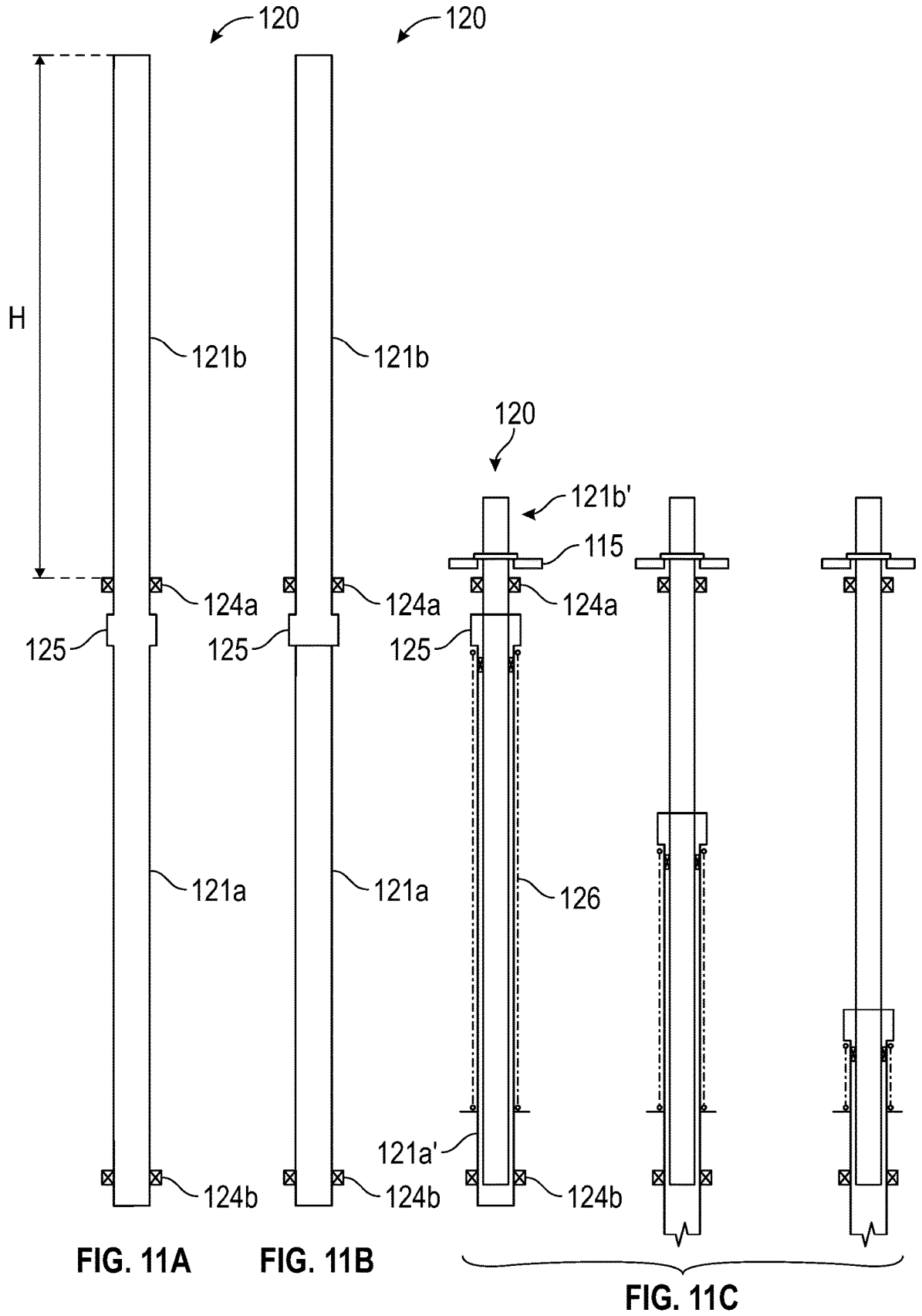
FIGS. 11A-11C illustrate schematic views for mandrels of the present disclosure.

FIGS. 11A-11C illustrate schematic views for mandrels 120 of the present disclosure. As shown in FIG. 11A and consistent with previous arrangements, the mandrel 120 can be a unitary component having an upper flow tube portion 121*b*, a piston portion 125, and a lower flow tube portion 121*a*. As shown in FIG. 11B, the mandrel 120 can be comprised of two or more components, facilitating assembly. For example, here, the upper flow tube portion 121*b* and the piston portion 125 may be a unitary component with the lower flow tube portion 121*a* being attached (e.g., threaded) thereto. An opposite arrangement can be used, or all three components 121*a*-*b*, 125 can be separate elements.

Finally, as shown in FIG. 11A, previous arrangements for the mandrel 120 require the assembly's housing to extend a give height H so that the upper flow tube portion 121*b* can ream sealed with the upper seal 124*a* as the mandrel 120 is moved down. The required height H can be reduced by using a telescopic arrangement for the mandrel 120.

For example, FIG. 11C illustrates a schematic view for a telescopic mandrel 120 of the present disclosure in which the mandrel 120 is comprised of two or more telescoping components. Here, the lower tube portion 121*b*' and the piston portion 125 can be a unitary component, while the upper tube portion 121*a*' is a telescoping component disposed in the lower tube portion 121*b*. The telescoping components use appropriate seals (not shown) and catches (not shown) therebetween. An edge of the upper tube portion 121*a* can be in contact with a shoulder 115 or the like of the assembly's housing. Movement downward by hydraulic pressure against the piston portion 125 can then stroke the lower tube portion 121*b*' down along the length of the upper tube portion 121*a*' against the bias of the spring 126. The upper seal 124*a* maintains a seal with the upper tube portion 121*a*'; the lower seal 124*b* maintain a seal with the lower tube portion 121*b*'; and an intermediate seal 124*c* seals between the tube portions 121*a*', 121*b*'. This stroking of the telescopic portions 121*a*', 121*b*' can reduce the height required for the assembly's housing, but the arrangement would increase the number of possible leak paths that need to be properly sealed.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An assembly for communicating a media through a wellhead to a media line in a well, the wellhead having at least one gate valve mounted above the wellhead, the assembly comprising:
   - a module configured to install in the wellhead and configured to support the media line extending therefrom;
   - a housing configured to mount above the at least one gate valve and having an insertion port for the media; and
   - a mandrel disposed in the housing and having a proximal end and a distal end, the mandrel defining a bore therethrough from the proximal end to the distal end for the media, the mandrel being movable between a retracted condition and an extended condition, the mandrel in the retracted condition having the distal end retracted from the at least one gate valve, the mandrel in the extended condition being extended through the at least one gate valve, having the distal end engaged with the module, and being configured to communicate the media with the media line.

2. The assembly of claim 1, wherein the module comprise a hanger configured to support the media line, the hanger having an external thread profile configured to install in the wellhead.

3. The assembly of claim 2, wherein the module comprises a valve being actuatable at least from a closed condition to an opened condition, the valve in the closed condition being configured to prevent fluid communication through the valve module, the valve in the opened condition being configured to allow fluid communication through the valve; and wherein the distal end of the mandrel in the extended condition is configured to actuate the valve from the closed condition to the open condition.

4. The assembly of claim 3, wherein the valve comprises:
   - a seat affixed in an internal passage of the hanger;
   - a poppet movable in the internal passage between seated and unseated conditions relative to the seat, a tip of the poppet being engageable by the distal end of the mandrel; and
   - a biasing element in the internal passage biasing the poppet to the seated condition.

5. The assembly of claim 1, wherein the mandrel comprises a valve disposed in the bore, the valve being movable between a closed condition and an opened condition in response to a pressure differential thereacross, the valve in the closed condition being configured to prevent fluid communication through the valve, the valve in the opened condition being configured to allow fluid communication through the valve.

6. The assembly of claim 1, comprising a biasing element disposed in the housing and biasing the mandrel to the retracted condition.

7. The assembly of claim 1, comprising a mechanism being configured to move the mandrel relative to the housing.

8. The assembly of claim 7, wherein the mechanism comprises:
   - a first gear associated with the housing and being movable; and
   - a second gear associated with the mandrel and being engaged with the first gear.

9. The assembly of claim 7, wherein the mechanism comprises a hydraulic actuator being configured to move the mandrel with hydraulic pressure communicated to a portion of the housing.

10. The assembly of claim 1, wherein the assembly is operated by hydraulic pressure; wherein the housing comprises: a first chamber having the insertion port for the media, and a second chamber having a hydraulic port for the hydraulic pressure; and wherein the mandrel is movable between the retracted condition and the extended condition in response to the hydraulic pressure in the second chamber.

11. The assembly of claim 10, wherein the mandrel comprises a piston portion sealed in the housing, the mandrel being movable in the housing in response to the hydraulic pressure in the housing applied against the piston portion.

12. The assembly of claim 11, wherein the housing comprises a first annular seal disposed in the housing and sealing an annulus between the housing and the mandrel, the first annular seal separating the housing into the first and second chambers, the second chamber having a first variable volume defined between the first annular seal and the piston portion.

13. The assembly of claim 12, wherein the housing comprises a second annular seal disposed in the housing and sealing the annulus between the housing and the mandrel, the distal end of the mandrel in the retracted and extended conditions being disposed beyond the second annular seal.

14. The assembly of claim 1, wherein the bore of the mandrel in the extended condition is configured to communicate hydraulics for the media from the insertion port to a capillary line for the media line supported by the module; wherein the bore of the mandrel in the extended condition is configured to communicate an eclectic cable for the media from the insertion port to another electric cable for the media line supported by the module; or wherein the bore of the mandrel in the extended condition is configured to communicate an optical cable for the media from the insertion port to another optical cable for the media line supported by the module.

15. An assembly operated by hydraulic pressure for fluid injection through a wellhead to a capillary line, the wellhead having at least one gate valve mounted above the wellhead, the assembly comprising:

a valve module configured to install in the wellhead and configured to support the capillary line extending therefrom, the valve module being actuatable from a closed condition to an opened condition, the valve module in the closed condition being configured to prevent fluid communication through the valve module, the valve module in the opened condition being configured to allow fluid communication through the valve module;

a housing configured to mount above the at least one gate valve, the housing comprising: a first chamber having an injection port for the fluid injection, and a second chamber having a hydraulic port for the hydraulic pressure; and a mandrel disposed in the housing and defining a bore therethrough from a proximal end to a distal end, the proximal end exposed in the first chamber, the mandrel being movable between a retracted condition and an extended condition in response to the hydraulic pressure in the second chamber, the mandrel in the retracted condition having the distal end retracted from the gate valve, the distal end of the mandrel in the extended condition extended through the at least one gate valve and configured to actuate the valve module from the closed condition to the open condition.

16. The assembly of claim 15, wherein the housing comprises a first annular seal sealing the annulus between the housing and the mandrel and dividing the housing into the first and second chambers.

17. The assembly of claim 15, wherein the mandrel comprises:

a first portion having the proximal end and being disposed in sealed engagement with the first annular seal;

a second portion having the proximal end; and a piston portion disposed between the first and second portions, the piston portion have a second annular seal sealed inside the housing, the second chamber defined by a variable volume between the first and second annular seals.

18. The assembly of claim 17, wherein the housing comprises a third annular seal disposed in the housing and sealing the annulus between the housing and the second portion of the mandrel, the distal end of the second portion in the retracted and extended conditions being disposed beyond the third annular seal.

19. The assembly of claim 15, comprising a biasing element disposed in the housing between a first shoulder in the housing and a second shoulder of the mandrel, the biasing element biasing the mandrel to the retracted condition.

20. A method for communicating a media through a wellhead to a communication line in a well, the wellhead having at least one gate valve mounted thereabove, the method comprising:

supporting the communication line with a module;

installing the communication line and the module through a top of the wellhead;

mounting a housing above the at least one gate valve of the wellhead;

moving a mandrel disposed in the housing from a retracted condition and an extended condition, a distal end of the mandrel in the retraced condition being retracted from the at least one gate valve;

engaging the distal end of the mandrel in the extended condition through the at least one gate valve to the module; and communicating the media from an insertion port in the housing, through a bore of the mandrel, and to the communication line supported by the module.

* * * * *